United States Patent [19]

Lindskoug

[11] 4,452,042

[45] Jun. 5, 1984

[54] PISTON ROD SEAL

[75] Inventor: Stefan Lindskoug, Malmö, Sweden

[73] Assignee: Mechanical Technology Incorporated, Latham, N.Y.

[21] Appl. No.: 430,924

[22] Filed: Sep. 30, 1982

[51] Int. Cl.[3] ..... F02G 1/04

[52] U.S. Cl. ..... 60/517

[58] Field of Search ..... 60/517, 521, 525, 526

[56] References Cited

U.S. PATENT DOCUMENTS 3,848,877 11/1974 Bengtsson et al. ..... 60/517

3,927,529 12/1975 Hakansson ..... 60/521

4,417,444 11/1983 Lundholm ..... 60/517 X

*Primary Examiner*—Allen M. Ostrager

*Attorney, Agent, or Firm*—Joseph V. Claeys; Arthur N. Trausch, III

[57] ABSTRACT

In a piston rod seal of the type comprising a gland through which the piston rod is passed the piston is provided with a sleeve surrounding the piston rod and extending axially so as to axially partly overlap the gland when the piston is in its bottom dead center position.

4 Claims, 4 Drawing Figures

PISTON ROD SEAL

The Government of the United States of America has rights in this invention pursuant to Contract No. DEN3-32 awarded by U.S. Department of Energy.

FIELD OF THE INVENTION

This invention relates to a piston rod seal for preventing leakage of gas between a piston rod and a wall through which the piston rod is passed.

DESCRIPTION OF THE PRIOR ART

Piston rod seals of the type referred to are used in double-acting multi-cylinder hot gas engines of the type in which each cylinder contains a piston separating two variable chambers and in which each piston is carried by a piston rod which is passed through one of the chambers and a stationary wall limiting the chamber, the piston rod seal being located in the stationary wall and comprising a gland sandwiched between a shoulder surface in the wall and an axially displaceable element, which is resiliently held axially against the gland and mounted in a cavity in the stationary wall.

A piston rod seal of this type has been described e.g. in U.S. Pat. No. 4,251,081.

In many practical applications it is desired to keep the dimension of the hot gas engine as small as possible in the axial direction of the cylinders. FIGS. 1 and 2 of this specification show two examples of the prior art in which a certain axial dimension is necessary.

OBJECT OF THE INVENTION

The object of the invention is to provide a piston rod seal of the type referred to which may be used in engines of smaller dimensions without any detrimental influence upon its properties.

SUMMARY OF THE INVENTION

A piston rod seal for preventing leakage of gas is according to the invention characterised in that the piston rod carries a sleeve surrounding the piston rod and extending axially through such distance as to axially partly overlap the seal gland in its position corresponding to the minimum volume of the variable volume chamber through which the piston rod is passed.

DETAILED DESCRIPTION OF THE DRAWINGS

Figure 1:
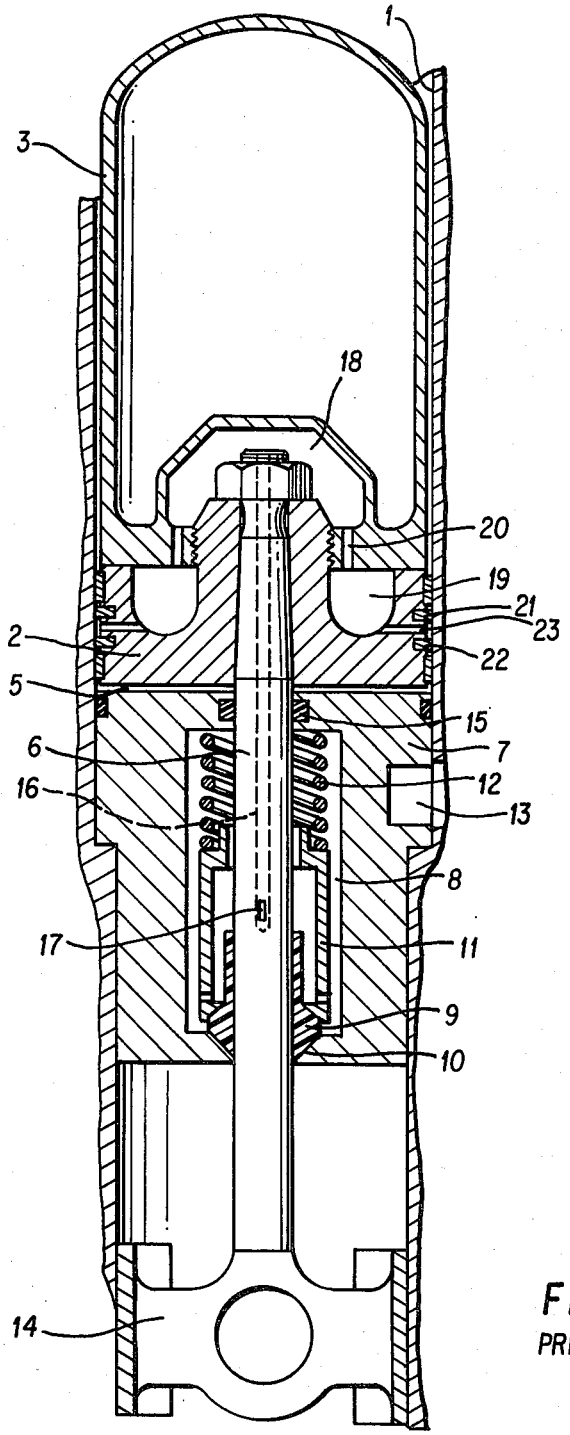
FIG. 1 PRIOR ART
FIG. 1 is an axial section through a known type of piston rod seal and its surroundings in a hot gas engine.

In the prior art device illustrated in FIG. 1 the reference numeral 1 designates a part of a cylinder wall forming a cylinder in which a piston 2 is slidably mounted. The piston 2 is provided with a piston dome 3 and separates an upper variable volume chamber 4 from a lower variable volume chamber 5. In the shown position of the piston 2 the lower variable volume chamber 5 is of minimum size. The piston 2 is carried by a piston rod 6 which is passed through the variable volume chamber 5 and a stationary wall 7 limiting the chamber 5. The wall 7 has a central cavity 8 in which a gland 9 is located. The gland 9 is sandwiched between a shoulder surface 10 in the wall 7 and an axially displaceable element 11 which is influenced by a compression spring 12. The cavity 8 is connected to a minimum working gas pressure source (not shown) of the hot gas engine via a connection 13. The piston rod 6 is at its lower end connected to a crosshead 14. At the upper end of the wall 7 a cap seal 15 surrounds the piston rod 6. The cap seal allows a slight leakage of gas from the chamber 5 containing working gas of a cyclically varying pressure to the cavity 8 containing gas at minimum pressure of the pressure cycle.

The piston rod 6 is provided with a central bore 16 terminating downwardly into a transverse bore 17, the bores 16 and 17 connecting the cavity 8 with a dome cavity 18. The dome cavity 18 is connected with a piston cavity 19 via bores 20 and the piston cavity 19 is connected to a space between two piston rings 21 and 22 and between the wall 1 and the piston 2, the connection being established by bores 23.

The piston rings 21 and 22 are designed as non-return valves—i.e. they allow gas to pass in direction from the space having the connections 23 to the two variable volume chambers 4 and 5, but not in the direction from the variable volume chambers into the space between the piston rings. Piston rings having such properties are described e.g. in the U.S. Pat. No. 3,927,529.

Figure 3:
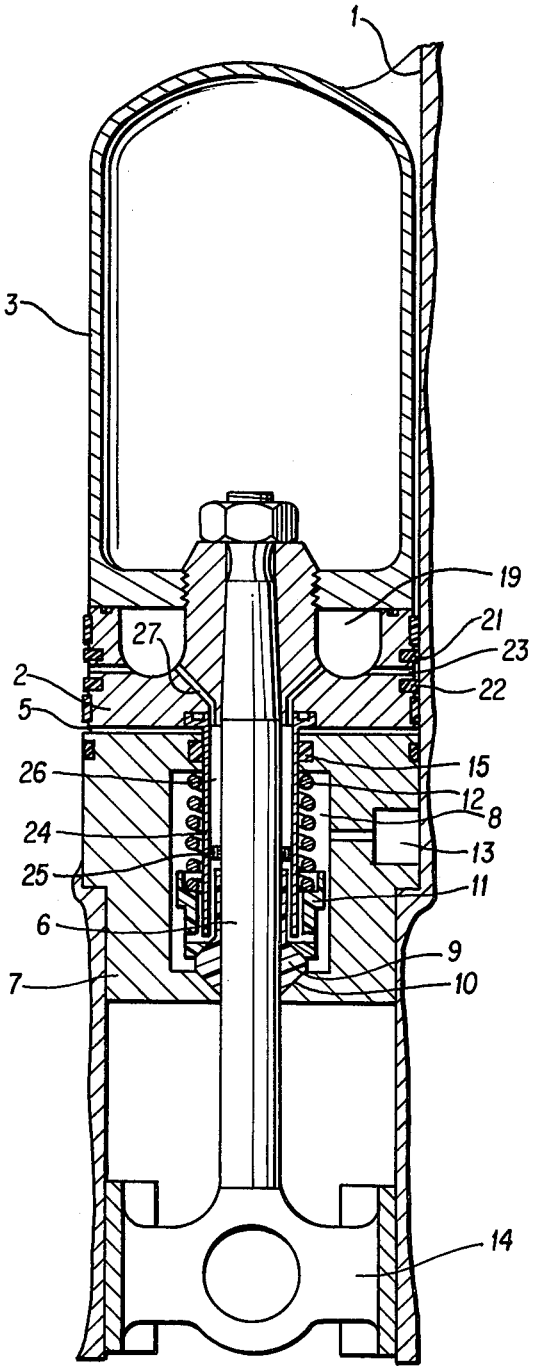
FIG. 3 is an axial section through a piston rod seal according to the invention and adapted to substitute the seal shown in FIG. 1.

It will be understood that the device described above and shown in FIG. 1 ensures that a minimum cycle gas pressure always prevails between the piston rings 21, 22. It will also be understood that the wall 7 must have such dimensions in the axial direction of the piston rod as to allow the transversal bore 17 to open into the cavity 8 during the total piston stroke. FIG. 3 shows how a piston rod seal according to the invention may result in a device having smaller dimensions in the axial direction of the piston rod.

In FIG. 3 elements corresponding to those shown in FIG. 1 have been provided with the same reference numerals. The piston 2 is according to the invention provided with a sleeve 24 surrounding the piston rod 6 and extending axially through such distance as to axially partly overlap the gland 9 in the position of the piston 2 corresponding to the minimum volume of the variable volume chamber 5. At its outer surface the sleeve 24 is engaged by the cap seal 15 and at its inner surface it is provided with a gas permeable supporting ring 25 guiding against the piston rod 6. The space 26 between the sleeve 24 and the piston 6 is directly connected to the piston cavity 19 via ducts 27.

It will be understood that the principal function of the device according to the invention and shown in FIG. 3 is the same as the function of the prior art device shown in FIG. 1. However, the bores in the piston rod have been dispensed with and thus the axial dimension of the cavity 8 has been substantially reduced.

Figure 2:
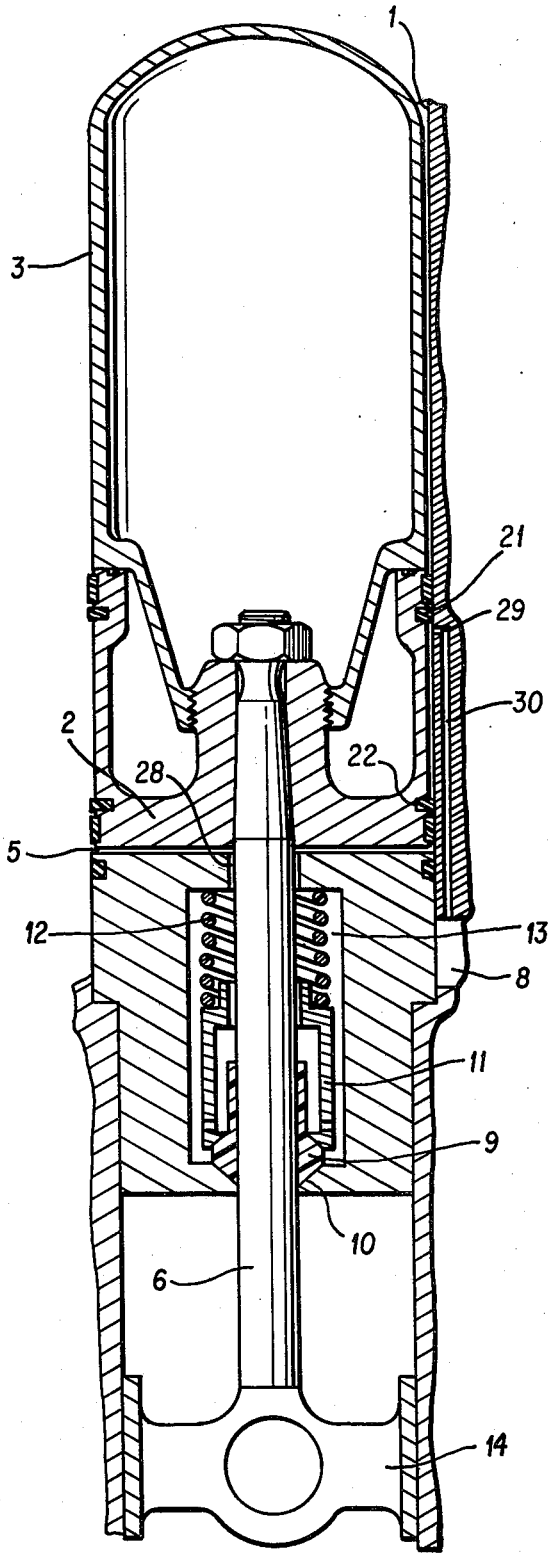
FIG. 2 PRIOR ART
FIG. 2 is a corresponding illustration of another known type of a piston rod seal.

FIG. 2 shows a prior art hot gas engine seal system of a different type. Elements previously shown in FIG. 1 have been provided with corresponding reference numerals.

In the known device shown in FIG. 2 the cavity 8 is in direct connection with the variable volume chamber 5 via an axial bore 28 having greater diameter than the piston rod 6 and no cap seal. Thus the cavity 8 will contain gas at the same cyclically varying pressure as that of the chamber 5.

The piston rings 21 and 22 are axially spaced sufficiently to allow a bore 29 to communicate with the space between them at any axial position of the piston 2. The bore 29 communicates via a bore 30 with the minimum gas pressure source connection 13.

During operation of the device shown in FIG. 2 gas is oscillating between the chamber 5 and the cavity 8 causing high gas velocities through the axial bore 28. The gas flow should not influence any part of the piston rod which at any part of the piston stroke comes into contact with the gland 9. Therefore the axial distance between the upper end of the gland 9 and the lower end of the bore 28 should exceed the piston stroke. The part of the piston rod contacting the gland 9 is covered by an oil film which should not be influenced by gas currents.

Figure 4:
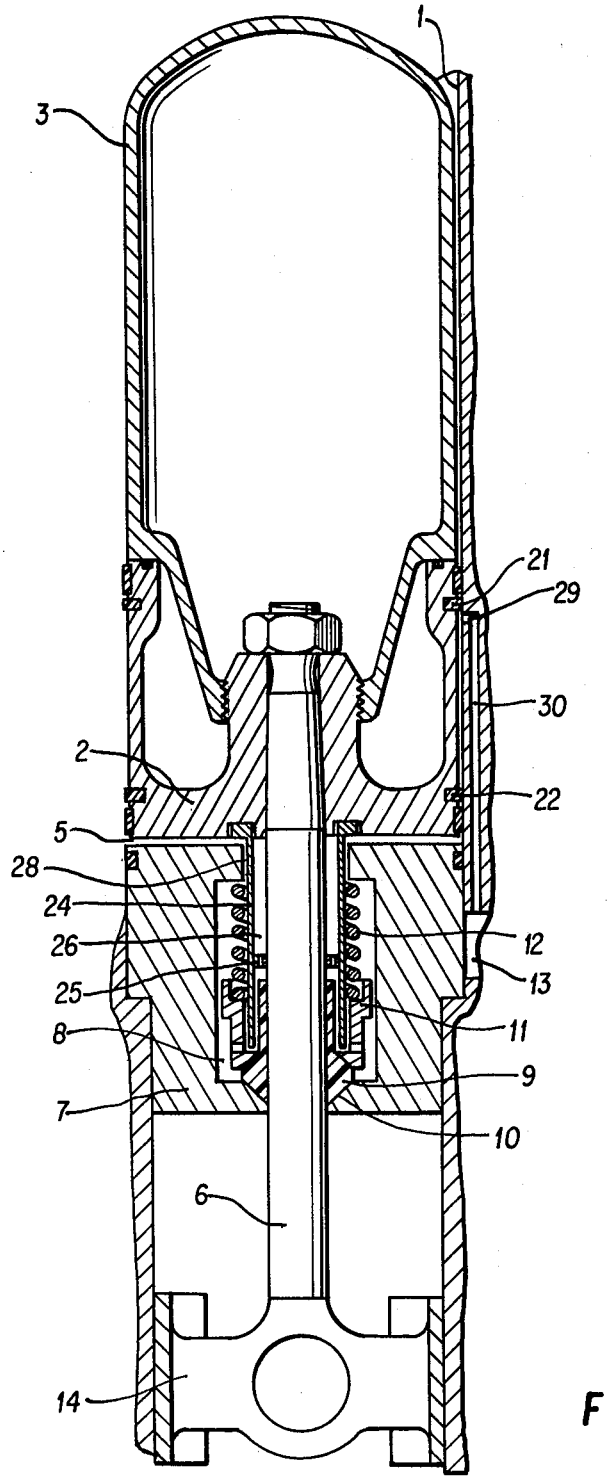
FIG. 4 is a similar illustration of a piston rod seal according to the invention and adapted to substitute the seal shown in FIG. 2.

FIG. 4 shows how a seal according to the invention could be used advantageously even in case of a varying gas pressure in the cavity 8.

The sleeve 24 and the piston rod 6 will limit an annular space 26 which in FIG. 4 is protected from any gas flows. The high velocity gas flow is located in and near the bore 28 and if the length of the sleeve 24 below the bore 28 exceeds the piston stroke in the position shown the surface of the piston rod 6 will always be protected from influence by the high speed gas flows between the chamber 5 and the cavity 8. Therefore, also in the embodiment of FIG. 4 the axial dimension of the wall 7 may be substantially reduced.

The invention being thus described, it will be obvious that the same may be varied in many ways.

Such variations are not to be regarded as a departure from the spirit and scope of the scope of the invention, and all such modifications as would be obvious to one skilled in the art are intended to be included within the scope of the following claims, wherein I claim:

1. A piston rod seal for a double-acting multi-cylinder hot gas engine of the type in which each cylinder contains a piston separating two variable volume chambers and in which each piston is carried by a piston rod which is passed through one of said chambers and a stationary wall limiting said chamber, said piston rod seal being located in said stationary wall and comprising a gland sandwiched between a shoulder surface in said wall and an axially displaceable element, which is resiliently held axially against said gland and mounted in a cavity in said stationary wall, characterised in that said piston carries a sleeve surrounding said piston rod and extending axially through such distance as to axially partly overlap said gland in its position corresponding to the minimum volume of the variable volume chamber through which the piston rod is passed.

2. A piston rod seal according to claim 1, characterised in that said sleeve carries a gas permeable supporting ring engaging the piston rod.

3. A piston rod seal according to claim 1, characterised in that said sleeve is engaged by another gland located in said stationary wall.

4. A piston rod seal according to claim 3, characterised in that a direct duct connection is established in the piston connecting the annular space limited by the outer wall of the piston rod and the inner wall of the sleeve with a space limited by two axially spaced piston rings and the adjacent walls of the cylinder and the piston.

* * * * *